United States Patent [19]

Warthmann

[11] Patent Number: 5,051,024

[45] Date of Patent: Sep. 24, 1991

[54] SLIDING CLOSURES FOR ROADWAY EXPANSION JOINTS

[76] Inventor: Robert Warthmann, Steinmüri 2, CH-8604 Volketswil, Switzerland

[21] Appl. No.: 475,508

[22] Filed: Feb. 6, 1990

[30] Foreign Application Priority Data

Feb. 6, 1989 [CH] Switzerland ..... 402/89

[51] Int. Cl.[5] ..... E04B 1/68; E01C 11/12

[52] U.S. Cl. ..... 404/57; 14/16.5; 404/60; 404/64; 404/66; 52/396

[58] Field of Search ..... 404/47, 50, 56–58, 404/60, 64–67; 52/396, 573, 586; 14/16.5, 16.1

[56] References Cited

U.S. PATENT DOCUMENTS

| | | | |
|---|---|---|---|
| 4,504,170 | 3/1985 | Schukolinski | 52/573 |
| 4,885,885 | 12/1989 | Gottschling | 404/59 |
| 4,901,495 | 2/1990 | Gottschling | 404/64 |

FOREIGN PATENT DOCUMENTS

| | | | |
|---|---|---|---|
| 1902548 | 8/1970 | Fed. Rep. of Germany | 14/16.5 |
| 2138741 | 2/1973 | Fed. Rep. of Germany | 14/16.5 |
| 2408544 | 8/1975 | Fed. Rep. of Germany | 14/16.5 |
| 1547975 | 11/1968 | France | 14/16.5 |
| 684081 | 9/1979 | U.S.S.R. | 14/16.5 |
| 684083 | 9/1979 | U.S.S.R. | 14/16.5 |

*Primary Examiner*—Bruce M. Kisliuk

*Attorney, Agent, or Firm*—Rothwell, Figg, Ernst & Kurz

[57] ABSTRACT

A sliding closure for a roadway expansion joint crossing has on the first part of the roadway (1) a sliding face (5) with a curved segment (7) and an adjoining level segment (8) running parallel to the driving surface (4). Resting flatly on this sliding face is a sliding plate (10) of elastomeric material and of uniform thickness. The sliding plate (10) is bolted onto the second part of the roadway (2) and bridges with a level section (12) a gap (11) between the first and second parts of the roadway (1, 2). In the level section (12), the sliding plate (10) is reinforced by a flexurally rigid steel plate (14). In the section resting on the curved segment (7), the reinforcement of the sliding plate (10) consists of a thin, flexible plate (15). Fastened on the first part of the roadway (1) is a tongue plate (32), which overlaps the sliding plate. This design enables the closure for the roadway expansion joint to be produced inexpensively, is simple to service, and has a shallow construction depth and a high corrosion resistance.

14 Claims, 3 Drawing Sheets

SLIDING CLOSURES FOR ROADWAY EXPANSION JOINTS

BACKGROUND OF THE INVENTION

A rolling closure for the roadway expansion joints of bridges is known from Swiss Patent Specification 581,752. The latter concerns a steel structure. A plurality of sliding bearers with cylindrical sliding faces being distributed over the width of the roadway are fastened on the first part of the roadway, the abutment. Flat swinging plates arranged next to one another are bolted onto the second part of the roadway, the bridge. Their free end rests by means of interchangeable sliding cams on two sliding bearers each. The swinging plates bridge the dilatation joint. Articulated at the free end of the swinging plates there is in each case a cylindrical sliding plate. The sliding plates likewise rest by means of sliding cams on the sliding faces of the sliding bearer. A tongue plate, fastened on the first part of the roadway and likewise segmented in the transverse direction of the roadway, overlaps the sliding plates. With this construction, if there is good alignment, a fairly smooth closure over the expansion joint can be achieved. However, this closure is expensive in production, and it requires a considerable construction depth, which leads to difficulties in particular in relatively thin parts of the bridge cantilevered transversely over the girder cross section. A major disadvantage of this crossing is the susceptibility to corrosion of the steel structure, in particular with regard to the use of thawing salt in winter. It is scarcely possible to provide a seal against salt solutions. These known closure must therefore be serviced and undergo expensive repairs at intervals of about 8 years.

In German Offenlegungsschrift 1,784,429, a sliding closure for an expansion joint is presented. In the case of these embodiments, the sliding plate consists of elastomeric material. As reinforcement, it has flexible bars which run in the longitudinal direction of the roadway, that is transversely to the expansion joint, and are bolted at the free end of the sliding plate to a guide plate and at the fastening end to a vertical steel plate arranged on the second part of the roadway. The sliding plate rests flatly on a row of steel bearers. In the case of some variants, these steel bearers bridge the expansion gap, are anchored on the first part of the roadway and protrude with their other end in a sliding manner into a box in the second part of the roadway. In still further embodiment, the steel bearers end at the free end of the first part of the roadway and, starting from there, have a cylindrical sliding face. These embodiments only have a modest load-bearing capacity. Due to the many steel parts exposed to corrosive salt water, the amount of servicing work is high.

In German Auslegeschrift 1,237,159, a roadway expansion joint crossing is described in which the two parts of the roadway engage one in the other in a tongue-like manner. The intermediate space between each tongue and the associated recess in what is respectively the other part of the roadway is covered in each case by a separate sliding closure. The closures consist of a series of interconnected metal strips which run transversely to the direction of travel and are guided in lateral guide rails. This construction too is expensive in production and in maintenance.

Finally, a closure in which the expansion joint is covered by a rubber plate is known from German Auslegeschrift 2,804,408. The rubber plate is bolted onto both parts of the roadway and has two grooves running parallel to the expansion joint both on its upper side and on its lower side. Flexurally rigid reinforcing plates are cast into the plate material. This crossing is only suitable for bridging relatively small expansion joints and generates very high restoring forces.

SUMMARY OF THE INVENTION

The present invention is based on the object of designing a closure for a roadway expansion joint in such a way that it can be produced inexpensively, is simple to service and can withstand high loads and has an improved corrosion resistance.

The closure for a roadway expansion joint according to the invention is arranged between a first part of the roadway and a second part of the roadway at a varying distance from the first part. It comprises a sliding face which is arranged on the first part of the roadway having a cylindrical segment, on which a sliding plate anchored on the second part of the roadway, rests in a slidable manner as well as a tongue plate which is anchored on the first part of the roadway and overlaps the sliding plate. The sliding plate consists of reinforced, flexible material which rests flatly on the sliding face and has at its anchorage end a level section which is flush with the roadway surface. The sliding plate bridges the gap between the first and second parts of the roadway and is fastened directly on the second part of the roadway. The sliding face extends essentially continuously over the width of the roadway. It has a level segment which adjoins the cylindrical segment tangentially and runs parallel to the roadway surface. The reinforcement of the sliding plate consists of at least one level, flexurally rigid steel plate cast into the plate material in the level section and a thinner, flexible plate adjoining it. The sliding plate has at the fastening end graduated through-holes, through which it is bolted onto the second part of the roadway.

Related objects and advantages of the present invention will be made more apparent by reference to the following figures and detailed description.

DETAILED DESCRIPTION OF THE INVENTION

Figure 1:
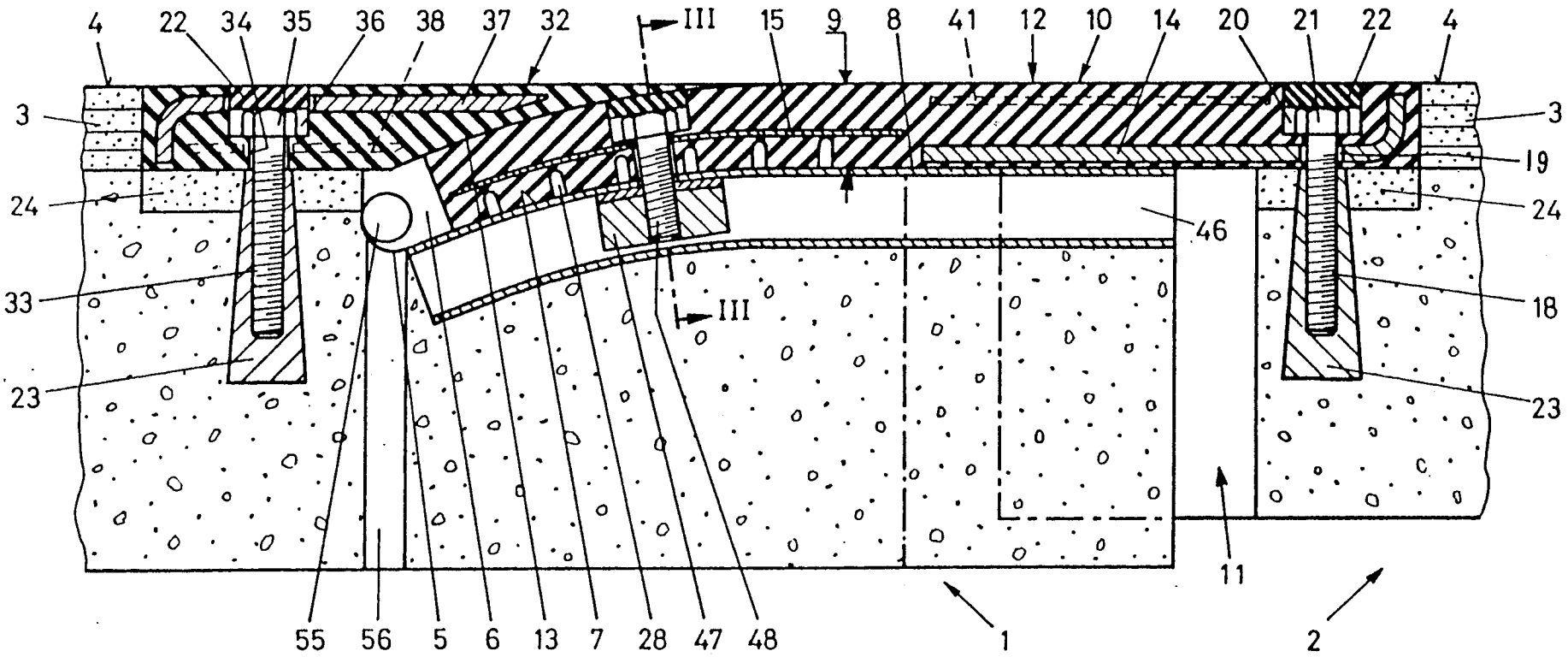
FIG. 1 shows a longitudinal section through a first embodiment.

The longitudinal section represented in FIG. 1 is a section through the expansion joint between an abutment 1 as first part of the roadway and the end of a bridge 2 as second part of the roadway. Both parts of the roadway 1, 2 have a top course 3 with flush, level surface 4. A sunken sliding face 5, continuously running transversely over the width of the roadway, is formed onto the abutment. The sliding face 5 is subdivided into a convexly arched or curved section 7 running out into a cavity 6, and a tangentially adjoining level section 8 running parallel to the surface 4. The section 8 is further down from the surface 4 by the thickness 9 of a sliding plate 10, which is uniform over its surface area. The sliding plate 10 consists of reinforced elastomeric material, such as an elastomer of natural rubber or preferably of ethylene-propylene. It has a level section 12 bridging the expansion gap 11 between bridge 2 and abutment 1, and an arched section 13 resting flatly on the arched section 7 of the sliding face 5.

The reinforcement comprises a level steel plate 14 which is arranged in the level section 12 and bent off in the shape of an L at the anchorage end, as well as a spring steel plate 15 which extends over the arched section 13. With the smallest-possible dilatation gap 11, the free end of the plate 14 still lies over the level section 8. The level section 12 is fastened at its fastening end facing the bridge 2 to the bridge 2 by a row of bolts 18. For this purpose, the sliding plate 10 has at the anchorage end a row of through-holes 19 with countersinks 20, in which the bolt head 21 is seated. The holes 19 extend through the plate 14. The countersinks 20 are sealed water-tightly by rubber plugs 22. The bolts 18 are bolted into dowels 23 in the bridge 2 and press the lower side of the sliding plate 10 against a smooth finish 24 of plastic-modified cast concrete. The upper side of the smooth finish 24 is parallel to the surface 4 and has a distance from the latter corresponding to the thickness 9 of the sliding plate 10. The material of the smooth finish 24 is also suitable in particular as the material for the uppermost layer of the abutment 1, forming the sliding face 5. Underneath the spring steel plate 15, there is a row of grooves 28 in the sliding plate 10. These extend transversely to the longitudinal direction A of the roadway and parallel to the axis of curvature of the section 7.

For bridging the cavity 6, a tongue plate 32 is fastened on the abutment 1 by additional bolts 33. The bolts 33 are again bolted into the dowel 23. The bolts 33 pass through holes 34 in the tongue plate 32. Their head 35 is countersunk in countersinks 36, which in turn are sealed by plugs 22. The tongue plate 32 likewise preferably consists of reinforced, elastomeric material, such as natural rubber of ethylene-propylene. However, when refurbishing existing steel structures, it may also be more economical to retain the existing steel tongue plate and only reconstruct the sliding face 5 as well as the anchorage of the sliding plate 10 on the bridge 2 and to use the sliding plate 10 according to the invention. In the case of new constructions, a tongue plate 32 of reinforced elastomeric material is preferred on account of the high corrosion resistance. As main reinforcement, it then has a level steel plate 37 which is arranged adjacent to its upper side and is bent off downwards in the shape of an L at the anchorage end. Tongue plate 32 may be supplemented by a further steel plate 38.

Figure 2:
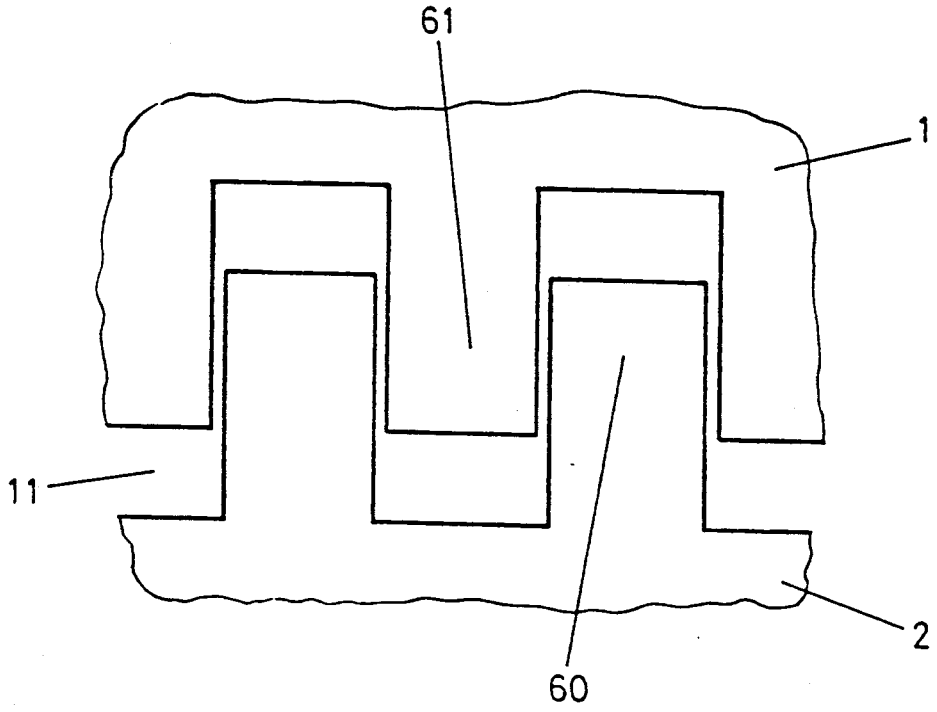
FIG. 2 shows a plan view of a part of the expansion joint according to FIG. 1 with the sliding plate removed.
Figure 3:
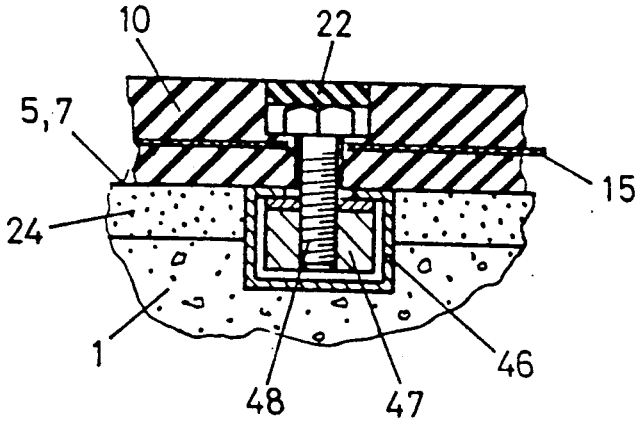
FIG. 3 shows a cross-section through the the anchoring portion of the closure for the expansion joint according to FIG. 1.

The sliding plate 10 may also be reinforced by additional molded-in steel plates 41 in the level section 12. If only a small dilatation gap 11 is to be bridged, that gap extends continuously transversely over the width of the roadway. In the case of larger dilatation gaps 11, on the other hand, it is expedient if the two parts of the roadway 1, 2 overlap in a tongue-like manner in the level section 8, as indicated in FIG. 1 by dot-dashed lines and represented in FIG. 2.

In this case, the widths of the overlapping tongues (60, 61) are substantially less than the maximum width of the expansion gap 11. In the case of this design, expansion joints 11 of virtually any widths can be bridged. This tongue-shaped engagement of the two parts of the roadway 1, 2 is not possible in the case of conventional rolling closure roadway crossings because there the expansion gap can only be bridged by the swinging plate, which has to be supported on both sides.

In order to avoid with certainty a wobbling of the section 13 of the sliding plate 10 on the section 7 of the sliding face 5, a plurality of C profiles 46, distributed transversely to the direction A of the roadway, are cast into the abutment 1. The mid-planes of these C profiles 46 extend parallel to the longitudinal direction A of the roadway, irrespective of whether the dilatation gap 11 extends perpendicularly to the direction A or is inclined thereto, which is the case with many bridges. In both cases, the mid-planes of the C profiles 46 extend parallel to the direction in which the dilatation occurs. Sliding blocks 47 are guided displaceably in the C profiles 46. The arched section 13 of the sliding plate 10 is connected to these sliding blocks 47 by bolt 48. As a result, a lifting-off of the section 13 from the sliding face 5, and consequently a wobbling when driven over, can be effectively prevented.

In order to improve the abrasion resistance of the sliding plate 10 on the concrete sliding face, the sliding plate 10 may be coated on its lower side in the section 13 with a plastic having sliding properties, for example with PTFE or polyamide.

The roadway crossing described above is extremely corrosion-resistant because, apart from the concrete, only corrosion-resistant elastomeric materials are exposed to the effects of weather and to corrosive salt solutions. If necessary, the very simply configured cavity 6 may be flushed by high-pressure flushing, for example through a lateral entry opening 55. The drainage and flushing water can be led away in a central outlet 56. In contrast to conventional rolling or sliding closures, the roadway expansion joint closure according to the invention causes little noise when driven over. It can also be arranged without any appreciable extra expense at an angle to the longitudinal direction of the roadway, which is very expensive in the case of conventional rolling or sliding closures. The sliding plate 10 according to the invention may extend in one piece continuously over the width of the roadway. As a result, sealing is possible without any problems. However, it may also be advantageous for servicing purposes to divide the sliding plate 10 widthwise into a plurality of segments. These segments can be sealed off with respect to one another by interlocking sealing strips. A single segment can then, if need be, be exchanged quickly, for example at night during a time of low traffic density. As a result, the disruption to traffic due to servicing is minimal. The closure for the roadway expansion joint according to the invention requires a shallow construction depth, meaning that it can also be used on slender bridges without additional thickenings in the region of the expansion joint. Due to the simple construction, the closure for the roadway expansion joint according to the invention can be produced inexpensively. It is also suitable in particular for the refurbishment of existing rolling or sliding closure steel structures.

Figure 4:
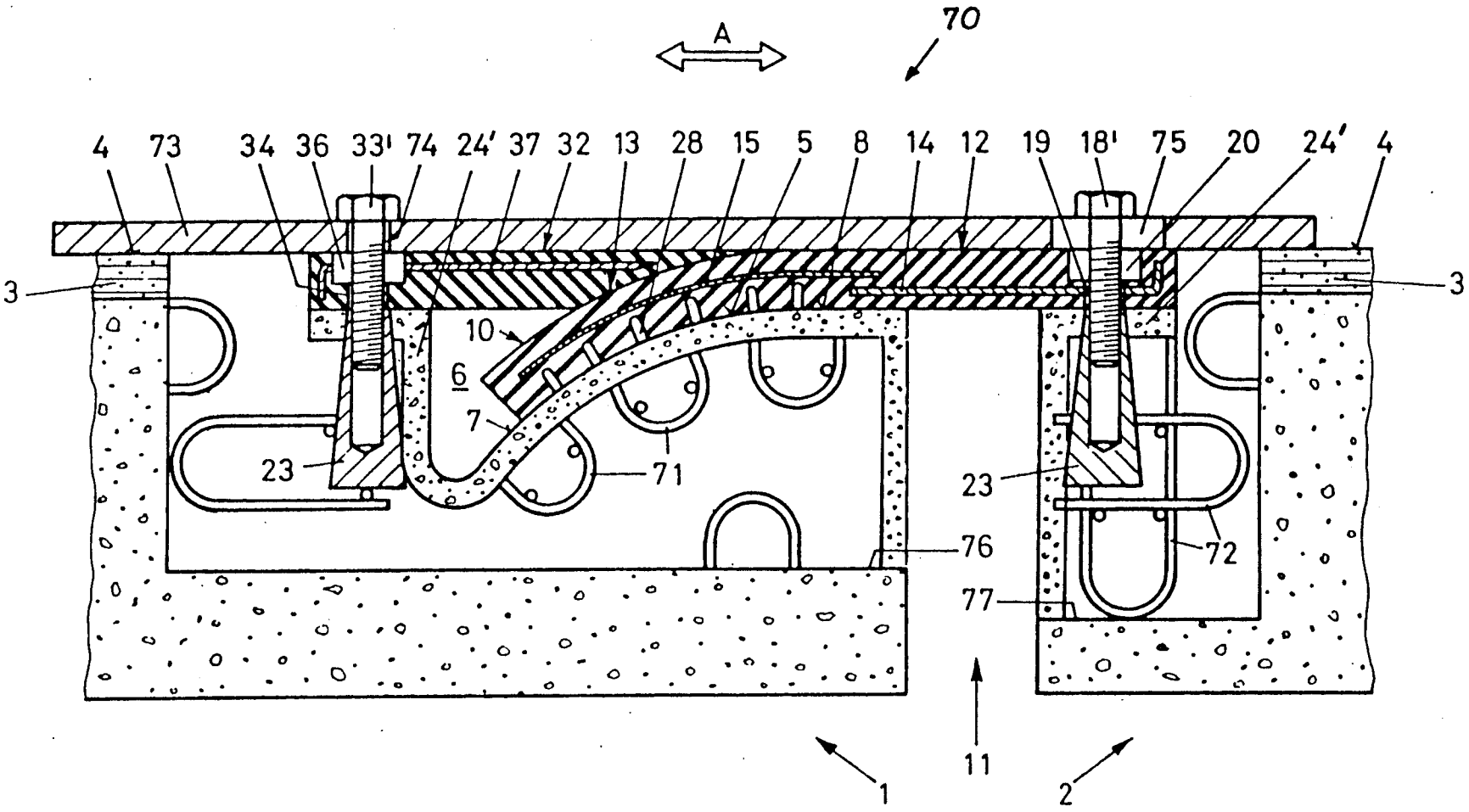
FIG. 4 shows a prefabricated constructional unit for the production of a closure for an expansion joint according to FIG. 1.

In FIG. 4, a prefabricated constructional unit 70 for the production of a closure of a roadway expansion joint according to FIG. 1 is represented. The elements in FIG. 4 having the same reference numbers as those in FIG. 1 are the same and perform the same functions as already described in connection with FIG. 1. The constructional unit 70 and consists of the sliding plate 10, the tongue plate 32 and of a reinforcing cage 71, 72. Each reinforcing cage 71, 72 is anchored in a permanent formwork 24', for example of polyester concrete, and is welded to the dowels 23, consisting of steel. At least two of the bolts 18, 33 in each case are substituted by longer bolts 18', 33', with which the two reinforcing cages 71, 72 are bolted to at least two beam-shaped girders 73. The girders 73 project beyond the sliding plate 10 and the tongue plate 32 at their fastening ends. At least one of the through-holes 74, 75 for the bolts 18', 33' in the girders 73 in each case is a slot, in order that the distance of the reinforcing cages 71, 72 from each other can be set according to the width of the dilatation joint 11 at the ambient temperature prevailing at the time of installation. The prepared parts of the bridge 1, 2 each have a cutout 76, 77. To produce the closure for the roadway expansion joint, the constructional unit 70 is placed into the cutouts 76, 77, the girders 73 being supported on both sides on the course 3. Then the intermediate space between the cutouts 76, 77 and the formwork 24' is filled with concrete. After hardening of the concrete, the girders 73 are removed. This design makes the installation time of the closure for the roadway expansion joint very short.

What is claimed is:

1. A sliding closure for an expansion joint between a first part of a roadway and a second part of a roadway wherein a variable gap is formed between the first part and the second part of the roadway, comprising:

a sliding face which is arranged on the first part of the roadway and has a curved segment;

a sliding plate anchored at one end on the second part of the roadway and resting at its other end on the curved segment of the sliding face in a slidable manner;

a tongue plate which is anchored on the first part of the roadway and overlaps the sliding plate;

the sliding plate comprising reinforced, flexible material resting flatly on the sliding face and having at its anchorage end a level section which is flush with the first and second parts of the roadway for bridging the gap between the first part and the second part of the roadway;

the sliding face extending essentially continuously over the width of the roadway and having a level segment which adjoins the curved segment tangentially and runs parallel to the roadway surface;

the reinforcement of the sliding plate comprising at least one level, flexural rigid steel plate cast into the plate material in the level section and a thinner, flexible plate adjoining the rigid plate; and the sliding plate having at its anchorage end graduated through-holes, through which it is bolted onto the second part of the roadway.

2. A sliding closure as set forth in claim 1, wherein the first and second parts of the roadway engage one another in a tongue-like manner underneath the level section.

3. A sliding closure as set forth in claim 1, wherein the material of the sliding plate comprises an elastomer.

4. A sliding closure as set forth in claim 3, wherein the elastomer is an ethylene-propylene.

5. A sliding closure as set forth in claim 1, wherein the sliding plate has a thickness which in uniform over its entire surface area.

6. A sliding closure as set forth in claim 1, wherein a lower side of the sliding plate is coated with plastic in its section resting on the sliding face.

7. A sliding closure as set forth in claim 1, wherein the sliding plate has on its lower side underneath the flexible plate grooves extending parallel to the expansion joint.

8. A sliding closure as set forth in claim 1, wherein the tongue plate comprises an elastomer, and wherein it is reinforced in its upper half by a further steel plate.

9. A sliding closure as set forth in claim 8, wherein the elastomer is an ethylene-propylene.

10. A sliding closure as set forth in claim 1, wherein a plurality of C rails are incorporated in the sliding face, wherein sliding blocks are displaceable in the C rails, and wherein the section of the sliding plate resting on the sliding face is fastened on the sliding blocks.

11. A sliding closure as set forth in claim 1, wherein the sliding face is comprised of concrete.

12. A sliding closure as set forth in claim 1, wherein the material of the sliding plate comprises natural rubber.

13. A sliding closure as set forth in claim 1, wherein the tongue plate comprises natural rubber, and wherein it is reinforced in its upper half by a further steel plate.

14. A sliding plate for a closure on a roadway expansion joint between a first part of a roadway and a second part of a roadway wherein a variable gap is formed between the first part and the second part of the roadway, comprising a sliding plate comprised of a reinforced, flexible material of uniform thickness over its entire surface area, wherein it has at an anchorage end through-holes with countersinks for fastening onto the second part of the roadway as well as a level, flexurally rigid reinforcing steel plate, enclosed in the material, wherein it includes on its section facing away from the anchorage end a flexible plate of spring steel which extends parallel to its face and is enclosed in the material, and wherein it has on the lower side, underneath the plate, grooves extending parallel to the expansion joint.

* * * * *